US006887098B1

(12) United States Patent
Luo et al.

(10) Patent No.: US 6,887,098 B1
(45) Date of Patent: May 3, 2005

(54) COMBINED ELECTRICAL CONNECTOR

(75) Inventors: Jizu Luo, Dong-Guan (CN); Hua Lian Li, Dong-Guan (CN)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 13 days.

(21) Appl. No.: 10/846,584

(22) Filed: May 17, 2004

(51) Int. Cl.[7] ..... H01R 13/60
(52) U.S. Cl. ..... 439/540.1; 439/701; 439/731
(58) Field of Search ..... 439/540.1, 906, 439/687, 696, 731, 701

(56) References Cited

U.S. PATENT DOCUMENTS 4,343,528 A * 8/1982 Lucius et al. ..... 439/731
5,314,357 A * 5/1994 Weidler ..... 439/701
5,437,564 A * 8/1995 Lignelet ..... 437/701
5,676,569 A * 10/1997 Davis ..... 439/731

* cited by examiner

*Primary Examiner*—Tho D. Ta
(74) *Attorney, Agent, or Firm*—Rosenberg, Klein & Lee

(57) ABSTRACT

The present invention provides a combined electrical connector comprising an upper and a lower covers that interlock with each other and define there-between multiple connector receiving cavities for multiple cable connectors received therein side by side for manipulation as a unit. The unit has a mating face wherein defines multiple openings and apertures beside the openings. The openings communicate with corresponding cavities. Each cable connector has a mating port at the front end and connects an electrical cable at the rear end. The mating port comes out from the corresponding opening, while the electrical cable comes out from the corresponding aperture. So the mating ports and the electrical cables are located in about the same orientation, which facilitates assembling the combined electrical connector with an electronic device and avoid inter-twisting the cables in the device.

11 Claims, 4 Drawing Sheets

COMBINED ELECTRICAL CONNECTOR

BACKGROUND OF THE INVENTION

1. Field of the Invention

The present invention relates generally to a combined electrical connector, and more especially to a combined electrical connector capable of combing multiple cable connectors side by side to be a unit.

2. The Related Art

Electrical connectors are commonly used in an electronic device to electrically connect periphery electronic components to the electronic device. With the fast development of electronic technology, more and more periphery electronic components are manufactured, so variety types of electrical connectors are largely required. In order to satisfy the consumer, Electronic manufacturers install multiple types of electrical connectors in the electronic devices to provide more mating ports for expanding functions freely. Traditionally, the electrical connectors are assembled with the electronic device one by one. So it takes lots of time to assemble and hinders to minimize the electronic device. Further, due to the division work, the system manufacturer requires the components manufacturer to make the electrical connectors assembled together in advance to simplify the latter assembling manipulation. Because of this requirement, manufacturers in this field compete each other to design variety of combined electrical connectors.

Taiwan patent No. 551650 discloses a traditional combined cable connector which has a first receiving cavity and a second receiving cavity disposed side by side inside an integrated insulation housing. A first cable connector and a second cable connector respectively locate in the corresponding cavities. Mating ports of the first and the second cable connectors both come out of the front of the insulation housing, and electrical cables come out of the rear.

Taiwan patent No. 573812 discloses another traditional combined electrical connector comprising an upper cover and a lower cover. The upper and the lower covers define recesses which have front open ends. Indentations are disposed on the rear end of the covers. The upper and lower covers latch with each other to surround cable connectors leaving mating ports of the cable connectors extending out through the front open ends, while electrical cables of the cable connectors pass through the indentations and extend rearward.

Each traditional combined electrical connector as described above has its mating port come out from the front end, while has the electrical cable come out from the opposite rear. When the combined electrical connector is assembled with an electronic device, the mating port comes out from the electronic device to connect with a mated connector, and the electrical cable connects with electronic components in the device. However, when the electronic component in the device is located opposite to the orientation of the electrical cable extending, it is inevitable to cause the electrical cable inter-twisting to connect the component in the electronic device. As a result, it does not make good use of the limited space of the electronic device, and is inconvenient for simplifying assembly.

SUMMARY OF THE INVENTION

Thus, an object of the present invention is to provide a combined electrical connector whose mating ports and electrical cables come out from approximately the same orientation to facilitate assembling the combined connector with an electronic device, and further to save inner space of the electronic device.

To attain the above object, the present invention provides a combined electrical connector comprises an upper and a lower covers that interlock with each other and define there-between multiple connector receiving cavities arranged side by side. Multiple cable connectors are received in the corresponding cavities side by side for manipulation as a unit. The unit has a mating face wherein define multiple openings and cable apertures beside the openings. Each opening communicates with the corresponding connector receiving cavity. Each cable connector has a mating port at the front end and connects an electrical cable at the rear end. The mating port of each cable connector comes out from the corresponding opening, while the electrical cable comes out from the corresponding cable aperture. So the mating ports and the electrical cables are located in about the same orientation, which facilitates assembling the combined electrical connector with the electronic device and avoid inter-twisting the cable in the device.

BRIEF DESCRIPTION OF THE DRAWINGS

A detailed explanation of a preferred embodiment of the present invention will be given, with reference to the attached drawings, for better understanding thereof to those skilled in the art.

DETAILED DESCRIPTION OF THE PREFERRED EMBODIMENT

Figure 1:
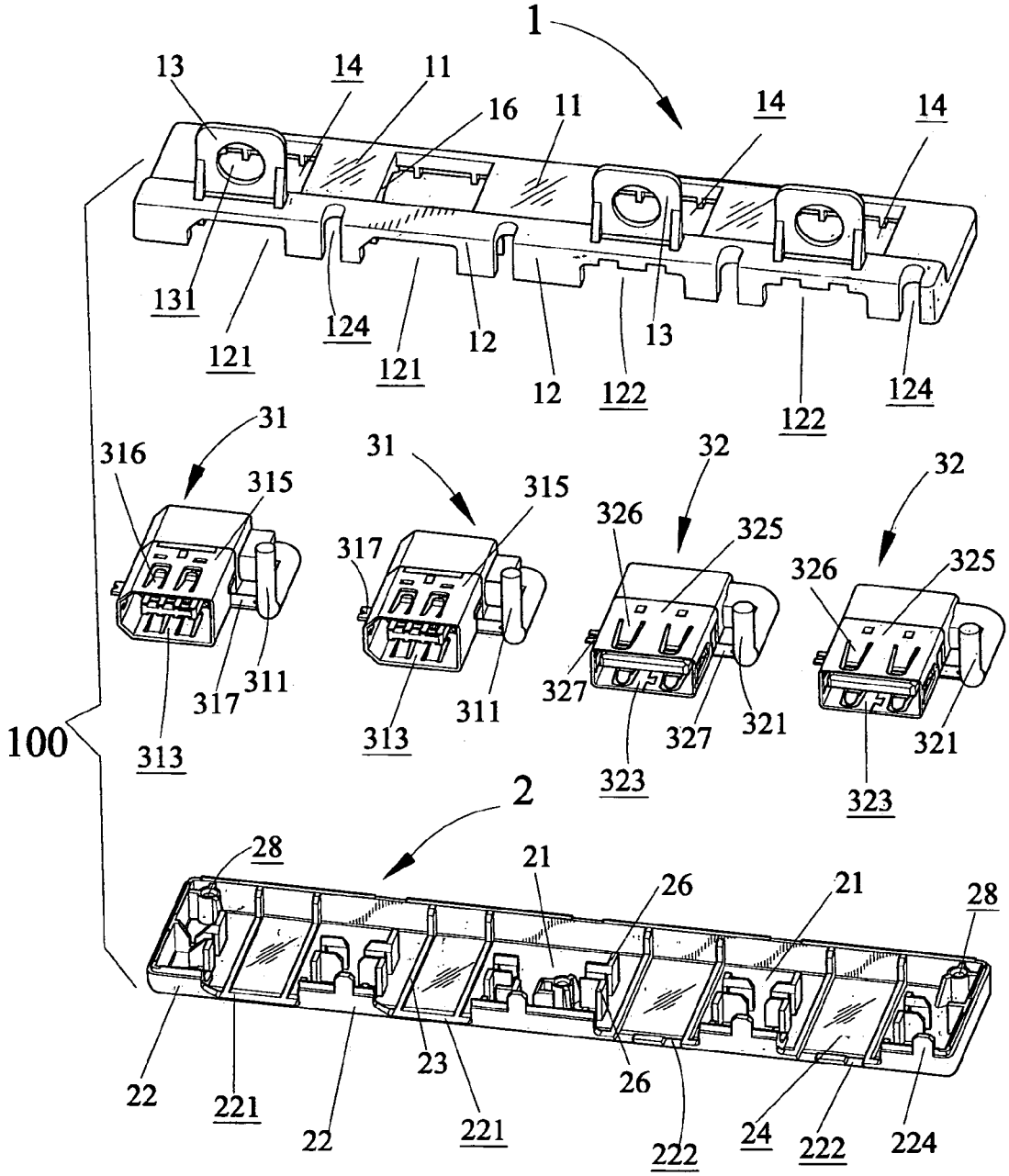
FIG. 1 is an exploded perspective view of a combined electrical connector according to the present invention.

Referring to FIG. 1, a combined electrical connector 100 comprises an upper and a lower cover 1, 2 that interlock with each other, and multiple cable connectors. The cable connectors are universal type connectors. In the preferred embodiment, the cable connectors include two IEEE (Institute of Electrical and Electronics Engineers) 1394 connectors 31 and two USB (Universal Serial Bus) connectors 32.

Each of the IEEE 1394 connectors 31 and each of the USB connectors 32 have a mating port 313, 323 at the front end and connects an electrical cable 311, 321 at the rear end. When the combined electrical connector 100 is assembled with an electronic device, the mating port 313, 323 respectively contacts with a mating connector, and the electrical cable 311, 321 electrically connects with electronic components in the device. The IEEE 1394 connectors 31 and the USB connectors 32 respectively have a shielding member 315, 325. The shielding member 315, 325 provides a pair of latch strips 317, 327 extending laterally from opposite sides thereof. An elastic portion 316, 326 is correspondingly defined around the mating port 313, 323 of the shielding member 315, 325

Figure 2:
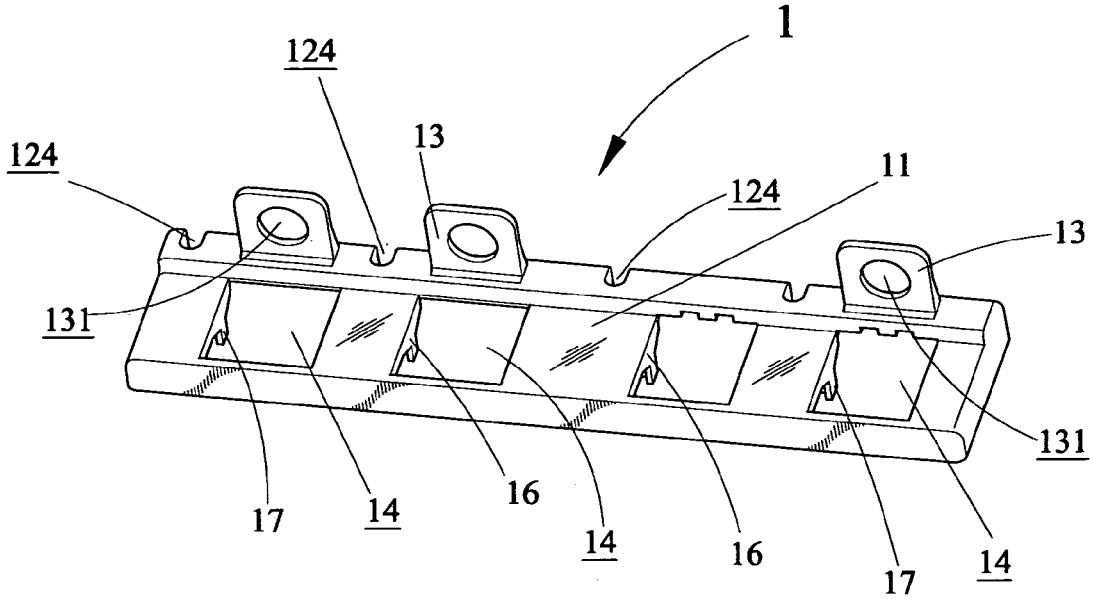
FIG. 2 is a perspective view of an upper cover as shown in FIG. 1.
Figure 3:
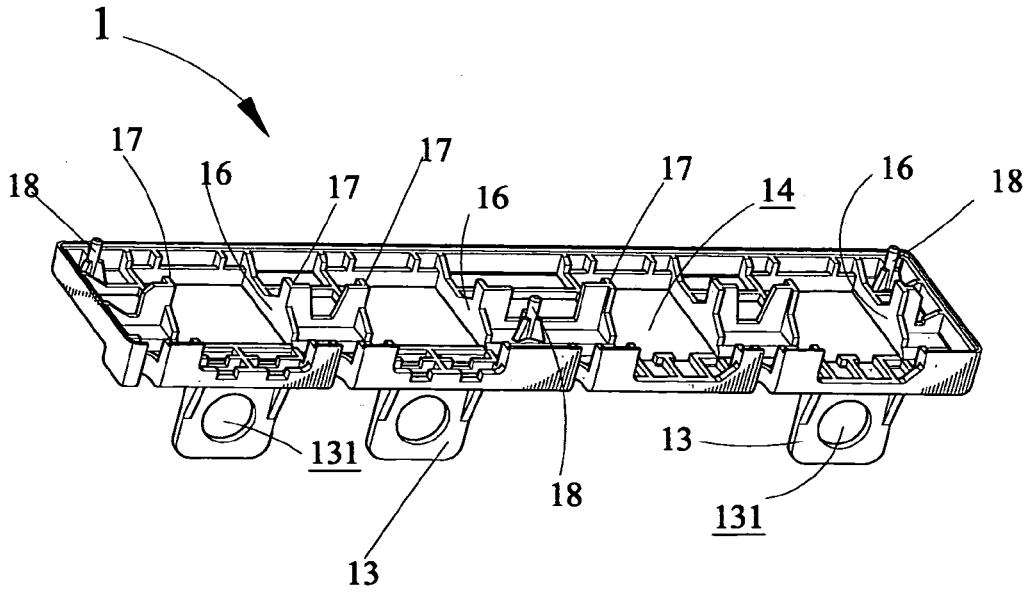
FIG. 3 is another perspective view of the upper cover as show in FIG. 1.

Referring to FIGS. 2 and 3, the upper cover 1 is composed of a top wall 11 and peripheral lateral walls including a front lateral face 12. The front lateral face 12 has indentations 121, 122 to respectively receive the upper portions of the IEEE 1394 connectors 31 and the USB connectors 32. A cable aperture 124 is defined close to each indentation 121, 122 in the front lateral face 12. The cable aperture 124 runs through the front lateral face 12 front to rear and up to down and further extends into the top wall 11 a predetermined depth. The electrical cable 311, 321 respectively comes out from the corresponding cable aperture 124. The top wall 11 of the upper cover 1 protrudes upwardly to form several protrusion members 13. Each protrusion member 13 is disposed a fixing cavity 131 to mechanically fix the combined electrical connector 100 to the electronic device. The top wall 11 further has rectangular cutouts 14 corresponding to the indentation 121, 122 to provide entry space for the IEEE 1394 connectors 31 and USB connectors 32. Each lateral side of the cutout 14 extends downwardly from an inner surface of the top wall 11 to form a lateral board 16. A middle portion of each lateral board 16 further protrudes downward to form a T-shaped latch 17. Furthermore, the top wall 11 forms a plurality of latch rods 18 protruding downward from the inner surface thereof for fixedly attaching the upper cover 1 to the lower cover 2.

Figure 4:
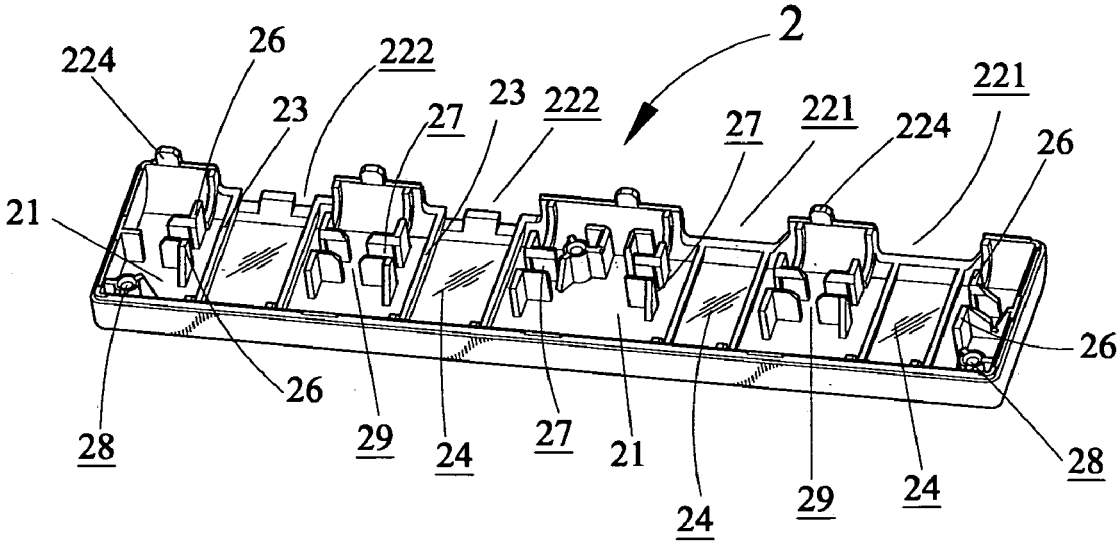
FIG. 4 is a perspective view of a lower cover as shown in FIG. 1.

Then, referring to FIGS. 1 and 4, the lower cover 2 is composed of a bottom wall 21 and peripheral lateral walls including a front lateral wall 22. The front lateral wall 22 has gaps 221, 222 to receive the lower portions of the IEEE 1394 connectors 31 and the USB connectors 32. Slices 224 are formed on the front lateral wall 22 protruding upwardly. Each slice 224 is positioned close to one gap 221, 222 and corresponds to one cable aperture 124 of the upper cover 1. A pair of L-shaped protrusion blocks 26 is upwardly positioned on the bottom wall 21 corresponding to each latch 17 of the upper cover 1. Each pair of the protrusion blocks 26 is set symmetrically and spaced a distance to define a latch groove 27 there-between. Beside the protrusion block 26 there is a passage 29 for the electrical cable 311, 321 passing through. The bottom wall 21 further defines several latch holes 28 for engaging with latch rods 18 of the upper cover 1 to secure the upper and the lower covers 1, 2. A pair of ribs 23 is positioned on the bottom wall 21 corresponding to each cutout 14 of the upper cover 1. The rib 23 extends from the rear wall to the front lateral wall 22 of the lower cover 2, and a biasing room 24 is formed between each pair of the ribs 23.

Figure 5:
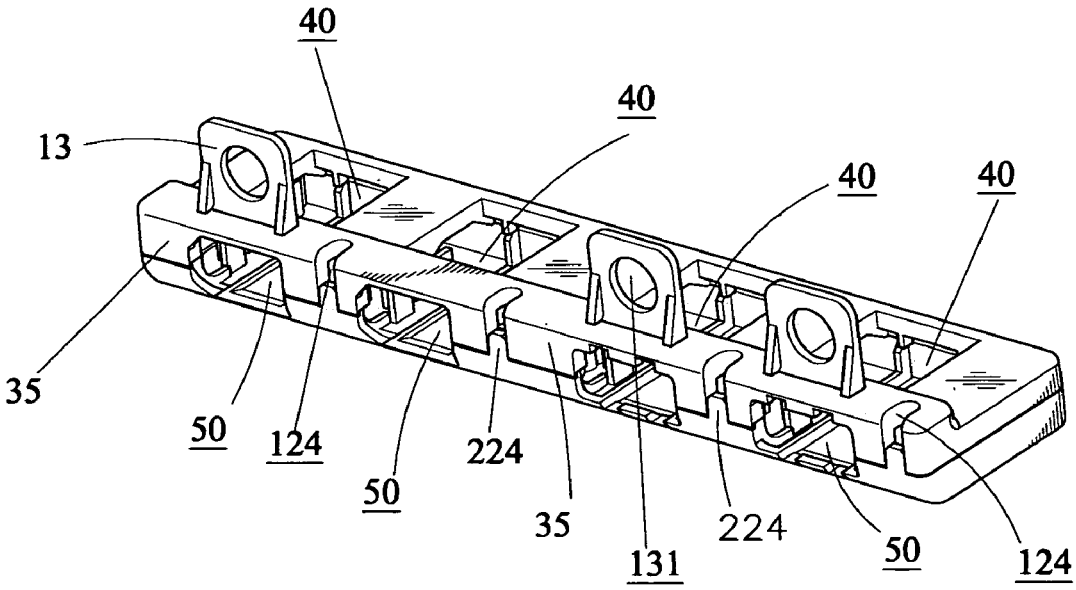
FIG. 5 is an assembled perspective view of the upper cover and the lower cover.

Referring to FIG. 5, when assembling the upper cover 1 and the lower cover 2, the slice 224 of the lower cover 2 wedges into the cable aperture 124 of the upper cover 1 to a position for exact locating the upper cover 1 and the lower cover 2. Each latch rod 18 of the upper cover 1 engages with the corresponding latch hole 28 of the lower cover 2 for secure the upper cover 1 and the lower cover 2. Thus, the upper cover 1 and the lower cover 2 are interlocked with each other as a unit and define there-between multiple connector receiving cavities 40, according to the preferred embodiment, there forms four connector receiving cavities 40. Two IEEE 1394 connectors 31 and two USB connectors 32 are respectively received in corresponding connector receiving cavity 40 side by side for manipulation as a unit. The lateral board 16 of the upper cover 1 and the protrusion block 26 together restrict the IEEE 1394 connectors 31 and USB connectors 32 to move from right to left.

After the upper cover 1 and the lower cover 2 are assembled, the front lateral face 12 of the upper cover 1 interlocks with the front lateral wall 22 of the lower cover 2 to form a mating face 35. The indentations 121, 122 of the upper cover 1 respectively aim at the gaps 221, 222 of the lower cover 2 to define openings 50. Each opening 50 communicates with the corresponding connector receiving cavity 40. Outlines of the openings 50 match with corresponding mating ports 313, 323, and the mating ports 313, 323 comes out from the openings 50.

Figure 6:
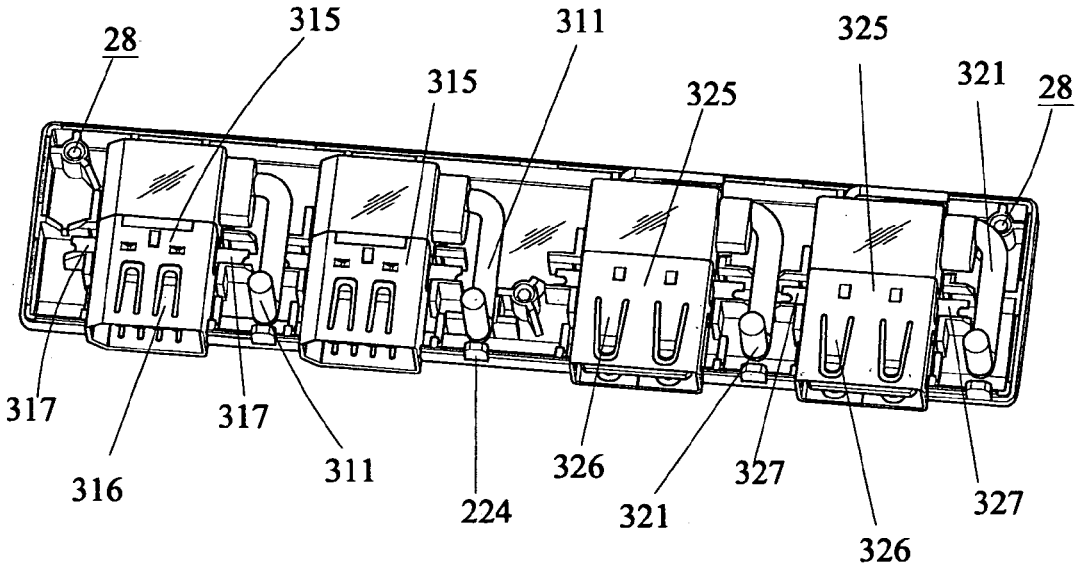
FIG. 6 is a perspective view showing cable connectors assembled in corresponding connector receiving cavities of the lower cover.

Referring to FIG. 6, when the two IEEE 1394 connectors 31 and the two USB connectors 32 are received in the connector receiving cavities 40 side by side, the IEEE 1394 connectors 31 and the USB connectors 32 are placed on the corresponding ribs 23, and the latch strips 317, 327 are respectively received in the corresponding latch grooves 27. The electrical cables 311, 321 are bent forward from the corresponding rears of the IEEE 1394 connectors 31 and the USB connectors 32, and further extend forward through the passages 29 to come out from the cable aperture 124. The elastic portions 316, 326 are biased into the corresponding biasing room 24 while mated connectors are plugged in the mating ports 313, 323.

Figure 7:
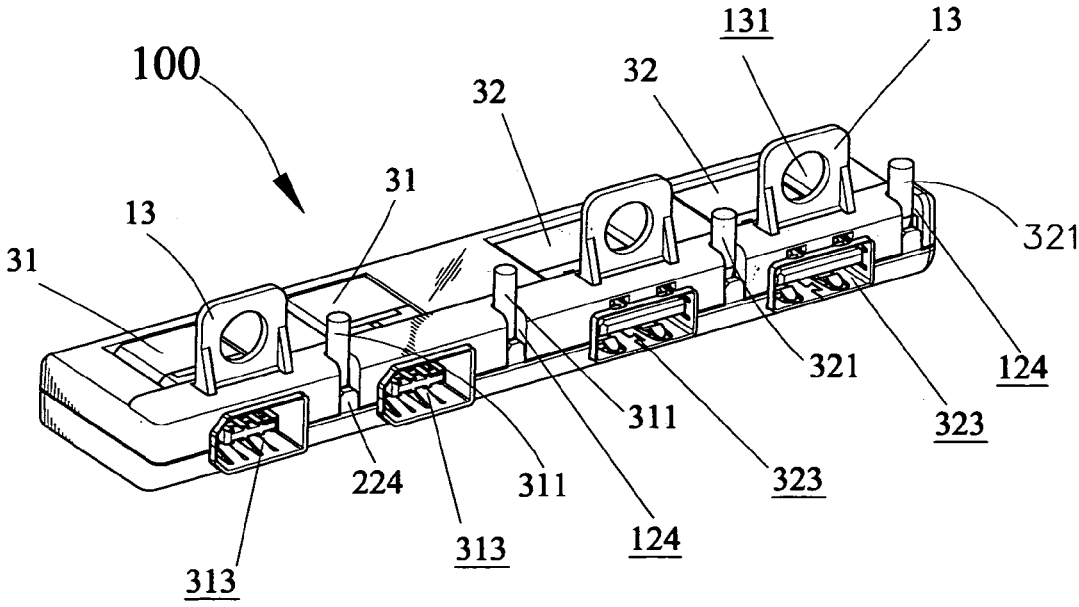
FIG. 7 is an assembled perspective view of the combined electrical connector according to the present invention.

Finally, with reference to FIG. 7, according to the assembling method as described above, during covering the upper cover 1 on the lower cover 2 that has been assembled with two IEEE 1394 connectors 31 and two USB connectors 32, the latch 17 wedges into the corresponding latch groove 27 to press on the latch strip 317, 327. So the two IEEE 1394 connectors 31 and the two USB connectors 32 are covered fixedly. Therefore, the mating ports 313, 323 of the IEEE 1394 connectors 31 and the USB connectors 32 come out from the corresponding openings 50 of the mating face 35, while the electrical cables 311, 321 come out from the corresponding cable apertures 124 of the mating face 35 either. As a result, the mating ports 313, 323 and the electrical cables 311, 321 of the combined electrical connector 100 are located in about the same orientation, which facilitates assembling the combined electrical connector 100 with the electronic device and avoid inter-twisting the cables in the device. In addition, it is more convenient for assembling manipulation when electronic components to be connected to the cables are adjacent to the mating face 35 of the combined electrical connector 100 in the electronic device.

Although a particular embodiment of the invention has been described in detail for purposes of illustration, variations and modifications to the embodiment disclosed herein, may be devised that are within the spirit of the invention and the scope of the claims.

What is claimed is:

1. A combined electrical connector comprising:

an upper cover;

a lower cover; and a plurality of cable connectors, each cable connector has a mating port at the front end and connects an electrical cable at the rear end; wherein said upper and said lower covers interlock with each other, and define there-between a plurality of connector receiving cavities side by side, said cable connectors are received in the cavities side by side for manipulation as a unit, the unit has a mating face wherein defines a plurality of openings and cable apertures beside the openings, the openings communicate with corresponding connector receiving cavities, the mating port of each cable connector comes out from the corresponding opening, while the electrical cable comes out from the corresponding cable aperture.

2. The combined electrical connector as claimed in claim 1, wherein the cable connector comprises an IEEE 1394 connector and a USB connector.

3. The combined electrical connector as claimed in claim 1, wherein an inner surface of the top wall forms a plurality of latches protruding downwardly, an inner surface of the lower cover correspondingly defines latch grooves, each of said cable connector provides a pair of latch strips extending laterally from opposite sides thereof, and the latch strips are received in the latch grooves, then the latches wedge into the latch grooves to press on the latch strips fixedly.

4. The combined electrical connector as claimed in claim 1, wherein an inner surface of the upper cover protrudes downwardly to form latch rods, an inner surface of the lower cover correspondingly protrudes upwardly to define latch holes for engaging with the latch rods.

5. The combined electrical connector as claimed in claim 1, wherein an inner surface of the bottom wall forms a pair of ribs corresponding to each of said connector receiving cavity.

6. The combined electrical connector as claimed in claim 1, wherein the top wall of the upper cover protrudes upwardly to form several protrusion members, each protrusion member has a fixing cavity.

7. The combined electrical connector as claimed in claim 1, wherein the upper cover is composed of a top wall and peripheral lateral walls including a front lateral face, the front lateral face has indentations; the lower cover is composed of a bottom wall and peripheral lateral walls including a front lateral wall, the front lateral wall has gaps, the front lateral face interlocks with the front lateral wall to form the mating face, the indentations aim at the corresponding gaps to define the openings.

8. The combined electrical connector as claimed in claim 7, wherein the cable aperture is disposed on the front lateral face, the cable aperture runs through the front lateral face front to rear and up to down and further extends into the top wall a predetermined depth.

9. The combined electrical connector as claimed in claim 7, wherein the top wall of the upper cover corresponding to each connector receiving cavity defines a cutout.

10. The combined electrical connector as claimed in claim 1, wherein an inner surface of the upper cover protrudes downwardly to form lateral boards, wherein an inner surface of the lower cover protrudes upwardly to form protrusion blocks, both of the lateral boards and the protrusion blocks restrict said cable connectors to move from right to left.

11. The combined electrical connector as claimed in claim 10, wherein beside the protrusion blocks there are passages for said electrical cables passing through.

* * * * *